United States Patent [19]

Peil et al.

[11] 4,282,462

[45] Aug. 4, 1981

[54] ARC LAMP LIGHTING UNIT WITH MEANS TO PREVENT PROLONGED APPLICATION OF STARTING POTENTIALS

[75] Inventors: William Peil, North Syracuse; Robert J. McFadyen, Syracuse, both of N.Y.

[73] Assignee: General Electric Company, Syracuse, N.Y.

[21] Appl. No.: 85,441

[22] Filed: Oct. 16, 1979

[51] Int. Cl.[3] ..... H01J 7/44; H01J 17/34; H01J 19/78; H01K 1/62

[52] U.S. Cl. ..... 315/46; 315/49; 315/104; 315/50; 315/DIG. 5; 315/208; 315/268; 331/113 A

[58] Field of Search ..... 331/113 A; 315/DIG. 5, 315/DIG. 7, 46, 49, 251, 252, 253, 256, 265, 266, 268, 50, 104, 208

[56] References Cited

U.S. PATENT DOCUMENTS

| | | | |
|---|---|---|---|
| 3,093,769 | 6/1963 | Kuhl et al. | 315/49 X |
| 4,002,999 | 1/1977 | Hesler et al. | 331/113 A |
| 4,004,251 | 1/1977 | Hesler et al. | 331/113 A |
| 4,017,780 | 4/1977 | Cowett, Jr. | 331/113 A |
| 4,104,715 | 8/1978 | Lawson, Jr. | 315/DIG. 5 |
| 4,188,660 | 2/1980 | Knoll | 331/113 A |

*Primary Examiner*—Saxfield Chatmon, Jr.

*Attorney, Agent, or Firm*—Richard V. Lang; Carl W. Baker

[57] ABSTRACT

The present invention relates to a lighting unit utilizing an energy efficient arc lamp as the main source of light supplemented by a standby filamentary lamp, the filament serving as a resistive ballast for the arc lamp during normal operation. The lighting unit is designed for functional similarity to an incandescent lamp, the filament providing immediate illumination when the lighting unit is first energized and continuing illumination until the arc lamp itself produces light. In accordance with the invention, if the arc lamp does not start within a predetermined period, the application of starting potentials produced through operation of a solid state switch and a high frequency step-up transformer is discontinued and the lighting unit rendered inactive. Exemplary means includes a positive temperature coefficient thermistor responsive to the temperature rise of the solid state switch. The solid state switch is connected in a normally off, monostable configuration and requires a trigger oscillator to generate a separate pulse for each switch conduction interval. The resistance rise in the thermistor is used to prevent trigger oscillations by causing saturation of the trigger oscillator transistor at a current level sufficient for self-heating of the thermistor. The solid state switch is latched in an off state until power is removed.

5 Claims, 4 Drawing Figures

ARC LAMP LIGHTING UNIT WITH MEANS TO PREVENT PROLONGED APPLICATION OF STARTING POTENTIALS

RELATED APPLICATIONS

U.S. Pat. No. 4,161,672 of Cap and Lake entitled "High Pressure Metal Vapor Discharge Lamps of Improved Efficiency".

Application of Peil and McFadyen entitled "A Transformer for Use in a Static Inverter", Ser. No. 969,381, filed Dec. 14, 1978.

Application of Peil and McFadyen entitled "Lighting Unit", Ser. No. 47,972, filed June 13, 1979.

Application of Peil entitled "A Pulse Generator Producing Short Duration High Current Pulses for Application to a Low Impedance Load", Ser. No. 974,253, filed Dec. 28, 1978.

BACKGROUND OF THE INVENTION

Field of the Invention

The present invention deals with a lighting unit energized from a 110 volt 60 hertz source in which the principal source of light is an arc lamp supplemented by a standby filamentary lamp, and which includes a power supply unit providing high frequency energy for starting the arc lamp while using dc for normal lamp operation.

The present invention deals with a lighting unit in which the principal source of light is a high pressure discharge lamp having up to six times the efficient of an incandescent lamp. High pressure metal vapor lamps have been available for some time in high power units. Recently, as disclosed in U.S. Pat. No. 4,161,672, smaller, low wattage metal halide lamps with efficiencies approaching those of the larger size have been invented. Such lamps are an energy efficient replacement for the incandescent lamp. When part of a lighting unit suitable for home use, provisions must be made for standby illumination and assuming two light sources, means must be provided for supplying the diverse electrical requirements of the two light sources.

The power supply of the present lighting unit employs a high frequency power supply in which a ferrite transformer controlled for non-saturated operation, a transistor switch, and a trigger oscillator are the principal components. Such power supplies have been termed static inverters in deference to the fact that "dc" quantities are converted to ac through static or non-moving parts. The inverter and ferrite transformer herein described are the subject of U.S. Applications Ser. No. 47,972 and Ser. No. 969,281.

In the starting sequence, such a power supply will initially produce high frequency energy at a high voltage for starting the arc lamp, after which the power supply reverts to a dc mode in which continuous dc is supplied. In such supplies, failure of the arc lamp may cause the supply to remain in the starting mode for an indefinite period. Continued operation in the starting mode is undesirable, resulting in the production of unnecessary electromagnetic interference and wasted power.

SUMMARY OF THE INVENTION

Accordingly, it is an object of the invention to provide a lighting unit combining a main arc lamp with a standby filamentary lamp having an improved operating network providing energization at an above audible frequency during starting and dc energization during warm-up and normal lamp operation.

It is another object of the invention to provide an improved lighting unit combining a main arc lamp with a standby filamentary lamp having an improved operating network providing high frequency starting energization and direct current running energization for the arc lamp, wherein means are provided for discontinuing the starting energization for the arc lamp if the arc lamp does not start within a reasonable period.

These and other objects of the invention are achieved in a novel lighting unit utilizing an energy efficient metal vapor arc lamp as the main source of light, supplemented by a standby filamentary light source, the filament thereof serving as a resistive ballast for the arc lamp. The lighting unit also includes a dc power supply and an operating network for converting 120 V 60 hertz energy into the forms needed for operating the main and standby lamp.

The operating network comprises an electrical transformer, a monostable, normally nonconductive, solid state switch, a trigger oscillator for causing intermittent conduction of the solid state switch, and latching means, typically a positive temperature coefficient resistor for latching the trigger oscillator in a non-oscillatory condition when intermittent operation is excessively long. With the production of trigger pulses prevented, the solid state switch remains off and starting potentials are discontinued.

In the practical circuit, the main arc lamp is connected in a series path between a node and one output terminal of the dc supply. The filamentary resistance is connected between the other output terminal of the dc supply and the node for normal energization and resistive ballasting of the main lamp. The electrical transformer has a primary winding connected between the other supply output between the terminal and the node, and a second winding connected between the node and one terminal of the main lamp for applying lamp starting potentials.

The monostable, normally non-conductive, solid state switch comprises a transistor connected between the node and the one supply output terminal. Intermittent operation of the switch develops an alternating potential in the primary winding and a transformed alternating potential in the second winding for starting or restarting the main lamp. A pulsating current in the filamentary resistance is also produced for standby illumination during starting. The trigger oscillator is responsive to the electrical state of the main lamp for causing intermittent switch conduction for starting or restarting the main lamp, and comprises a second transistor having base, emitter and collector electrodes.

The thermal latch comprises a positive temperature coefficient thermistor, thermally coupled to a member experiencing a greater temperature rise during starting or restarting than during normal energization, typically the switching transistor. The thermistor is electrically connected in the current path between the collector of the second trigger oscillator transistor and the node. When the thermistor is at a low temperature corresponding to normal operation, its resistance is low and trigger oscillations are permitted. When at an elevated temperature corresponding to abnormal operation, its resistance is high and trigger oscillations are stopped by biasing the second transistor into saturation. The saturation current level is set to provide sufficient self-heating in the thermistor to keep it at a high resistance adequate to prevent further oscillations until the lighting unit is de-energized and the thermistor is allowed to cool.

The trigger oscillator is a relaxation oscillator whose base and emitter electrodes are used to sense the voltage and the current in the arc lamp for starting or restarting. Using saturation induced by a collector connected thermistor as the means of turning off the trigger oscillator when the starting process is too long, does so without interference with the starting sensors.

In accordance with another facet of the invention, one terminal of the positive temperature coefficient resistor is electrically connected to the node to which the collector of the switching transistor is also connected. This permits the mechanically convenient mounting of the positive temperature coefficient resistor to the metal collector tab of the switching transistor for efficient thermal coupling.

BRIEF DESCRIPTION OF THE DRAWINGS

The novel and distinctive features of the invention are set forth in the claims appended to the present application. The invention itself, however, together with further objects and advantages thereof may best be understood by reference to the following description and accompanying drawings in which:

DESCRIPTION OF PREFERRED EMBODIMENT

Figure 1:
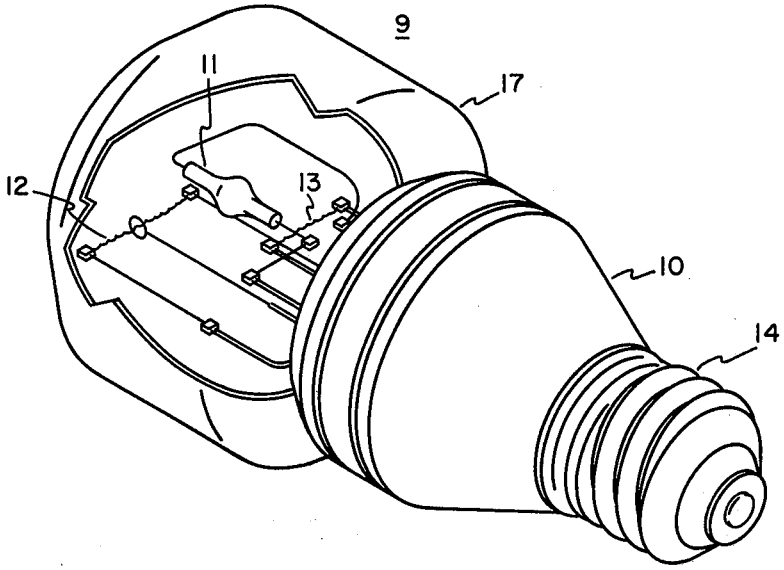
FIG. 1 is an illustration of a novel lighting unit suitable for connection to a standard lamp socket using an arc lamp as the principal light source, and a standby light source and a compact power supply unit providing starting and operating potentials for the light sources.

Referring now to FIG. 1, a lighting unit for operating from a conventional low frequency (50–60 Hz) alternating current power source is shown. The lighting unit comprises a lamp assembly which produces light, and a power supply unit which supplies electrical power to the lamp assembly, with certain elements of the lighting unit having dual light production and ballasting functions. The lamp assembly includes a glass enclosure 9 which contains a high efficiency arc lamp 11 and filamentary resistance elements 12 and 13 for both ballasting and supplemental light production. The power supply unit includes a rigid case 10 attached to the glass enclosure 9 and a screw-in plug 14. The plug 14 provides both electrical connection and mechanical attachment of the lighting unit to a conventional ac lamp outlet. The power supply unit develops the required energization for the arc lamp during starting and operating conditions, provides immunity to certain line transients, and supplies power for supplemental incandescent illumination as needed during starting of the lamp.

The lighting unit may be switched on, restarted, or turned off with the same immediate production of light as an incandescent lamp. During the half minute periods that it may take for the arc lamp to reach full brightness after a cold start or the longer periods required for a hot restart, supplemental incandescent illumination is provided.

The disposition of the elements of the lamp assembly are best seen in FIG. 1. The arc lamp 11, the 60 watt filamentary resistance 12, and the 40 watt filamentary resistance 13, are all installed inside the single large glass envelope 9. The elements 11 through 13 are supported on leads sealed into the base of the lamp assembly. The gas filling the envelope 9 is an inert gas suitable for a conventional incandescent lamp. The arc lamp 11 is shown with the positive electrode or anode down (near to the base) and the negative electrode or cathode up (remote from the base). The two electrodes are in turn sealed into the ends of a small quartz vessel whose outer contour is cylindrical except for a small central region of larger cross section, of less than $\frac{1}{2}''$ in diameter. The interior of the arc lamp, which is not specifically illustrated, contains a spherical or elliptical central chamber filled with an ionizable mixture: argon, an ionizable starting gas, mercury, which is vaporized when hot, and a vaporizable metal salt such as sodium and scandium iodides. When operating, an arc is formed between the electrodes which creates illumination throughout the chamber. Small, low power lamps of the type just described are referred to as metal halide or metal vapor lamps. A suitable lamp is more fully described in the earlier cited U.S. Pat. No. 4,161,672.

Light production is shared between the arc lamp 11 and the filamentary resistance 12, while the latter and the filamentary resistance 13 provide resistive ballasting for the arc lamp. In dimmed operation, the current levels and therefore the brightness of the arc lamp is reduced by the imposition of resistance 13 in the current path. In normal "final run" operation, the filamentary resistance 12 (and 13 if dimmed) conducts the current flowing in the arc lamp but primary light generation occurs in the arc lamp. During normal final run operation the power supplied to the arc lamp is dc having some low frequency (50–60 Hz) ripple which is unobjectionable from the point of view of electromagnetic interference (EMI).

In starting or restarting and warm-up of the main arc lamp, the filamentary resistance (12 primarily) produces supplemental illumination. In starting or restarting, the power supplied to the arc lamp and filaments has substantial high frequency content, which may be objectionable from the point of view of electromagnetic interference. In accordance with the invention, means are provided for preventing prolonged starting, such as might occur when arc lamp failure precludes ignition.

The arc lamp exhibits several distinct states in conventional use and each active state requires distinct energization. From a practical viewpoint, the arc lamp has three essentially active states denominated Phases I–III and an inactive state.

In Phase I, "ignition" occurs. The duration of ignition should be no longer than a second or two and is often much shorter. It is the time required for a suitably high voltage to cause "electrical breakdown" of the gas contained in the arc lamp to initiate a falling maximum lamp voltage. This latter condition is also referred to as the establishment of a "glow discharge".

Phase II—the glow to arc transition—extends from one-tenth of a second to perhaps two seconds and is characterized by a more sustained ionization level and a lower maximum voltage. As Phase II begins, the discharge is typically unstable, swinging between a maximum and a minimum value, with the voltage of the discharge falling continuously toward a lower maximum with a recurring minimum near 15 volts. As the average level of gas conduction increases, the maximum lamp voltage falls, the consumed power increases, and the temperatures inside the lamp also increase. As the maximum arc voltage falls through values near 200–400 volts, a more substantial energy (typically 2–4 watts) is required by a metal vapor lamp.

Phase III begins with the establishment of the "arc" which occurs when a portion of the cathode has reached thermionic emission temperatures. At the marked transition from Phase II to Phase III, the voltage of the discharge loses its unstable quality and holds to an initial value of about 15 volts. In Phase III, a sustained low lamp impedance is exhibited, and current limiting is required to prevent excessive heating. At the beginning of Phase III, the lamp dissipation is set to be between 10 and 15 watts and significant light production starts.

The warm-up period, which is the initial portion of Phase III, normally lasts from 30–45 seconds. During the warm-up period, the lamp reaches full operating temperature and the contained gases reach their high, final operating pressures. The voltage across the lamp increases to a value of typically 87 volts with an accompanying reduction in lamp conductance. When the final run condition occurs, the lamp absorbs the maximum power (typically 32 watts) and the maximum light output is produced.

The pre-ignition period is a variable period having a nominal minimum value of zero at standard ambient conditions and a maximum value between 45 seconds and 4 minutes if there has been a failure of the arc and a hot restart is required. If the lamp is de-energized in the course of normal operation, the lamp will be at an elevated temperature and at a high gas pressure for a short while. To restrike the arc when the lamp is hot, the potential required may be in excess of an order of magnitude more than for a cold start (e.g., 10–30 KV). The thermal time constants of the lamp are such that the time required for cooling from a hot operating condition to the point where a conventional (1–2 KV) voltage will restrike an arc may be from 45 seconds to 4 minutes.

Supplemental incandescent illumination is particularly important during the longer warm-up and pre-ignition periods, but in the interests of steady illumination, supplemental incandescent illumination is provided through the shorter periods (ignition and the glow to arc transition) as well.

Figure 2:
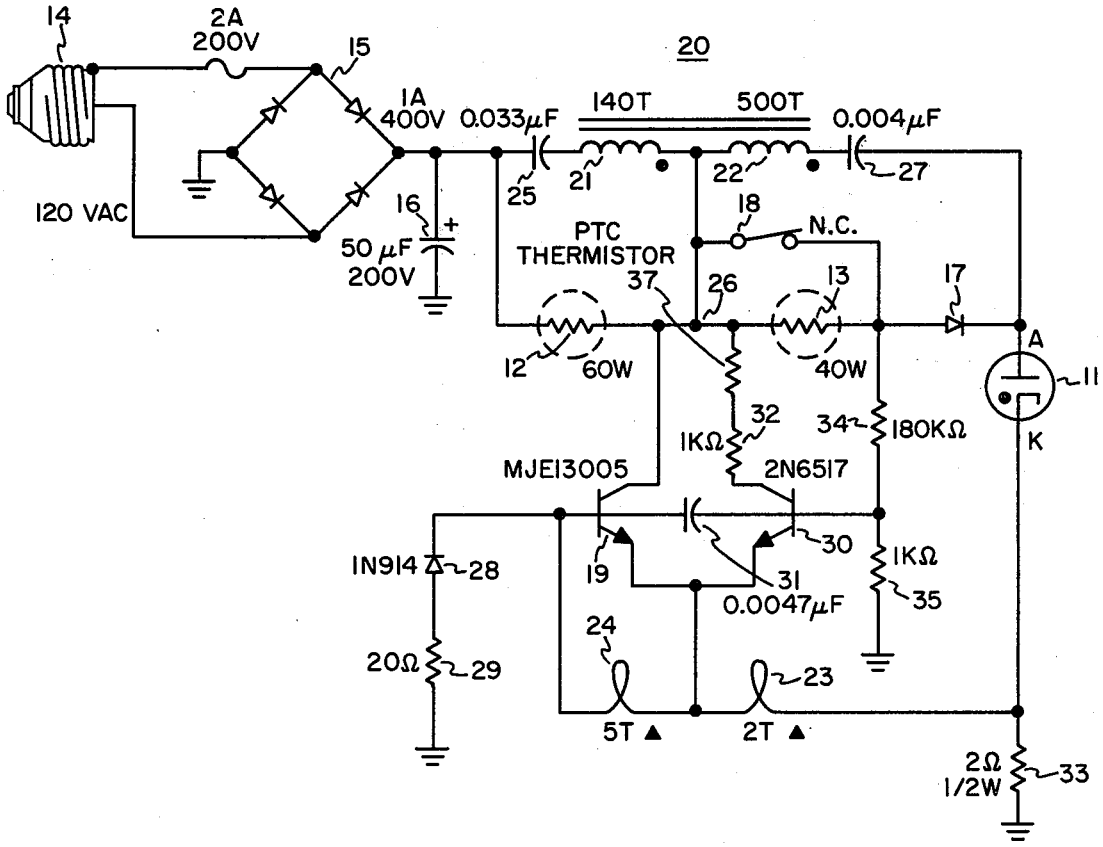
FIG. 2 is an electrical circuit diagram of the lighting unit.
Figure 3:
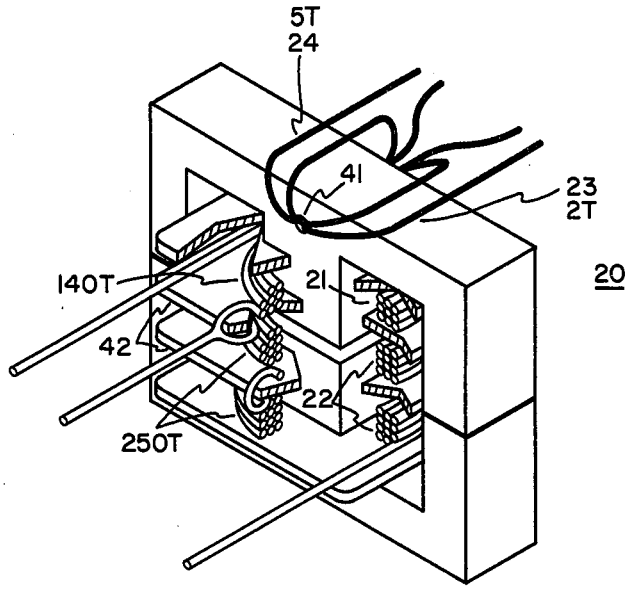
FIG. 3 is an illustration of a ferrite transformer which forms a portion of the power supply unit.

Suitable operating power for the arc lamp and the standby light producing filament is provided by the power supply illustrated in FIG. 2.

The lighting unit whose electrical circuit diagram is illustrated in FIG. 2, has as its principal components the arc lamp 11, a dc power supply (14, 15, 16) for converting the 120 volt 60 Hz to dc, an operating network (17–37) for converting electrical energy supplied by the dc power supply into the forms required for operation of the lamp assembly and finally two filamentary resistances (12 and 13) which perform a ballasting function in the operating network, and one (12) of which enters into the production of standby light.

The dc power supply circuit of the generating network is conventional. Energy is supplied from a 120 volt 60 hertz ac source via the plug 14 and two input connections to the ac input terminals of a full wave rectifier bridge 15. The positive output terminal of the bridge becomes the positive output terminal of the dc supply and the negative output terminal of the bridge bridge becomes the common or reference output terminal of the dc supply. The filter capacitor 16 is connected across the output terminals of the dc supply to reduce ac ripple. The output of the dc power supply during normal run operation of the arc lamp 11 is 145 volts at about ½ amperes current, producing an output power of approximately 50 watts of which 32 watts is expended in the lamp. The power required of the dc power supply by the lighting unit during a hot restart is approximately 60 watts and the maximum required during warmup of the arc lamp is approximately 75 watts.

The operating network, which derives its power from the dc supply, and in turn supplies energy to the lamp assembly, comprises the elements 17–37 (optionally 12 and 13) connected together as follows: The filamentary resistance 12 and 13, diode 17, arc lamp 11 and lamp current sensing resistance 33 are serially connected in the order recited between the positive terminal and the common terminal of the dc supply. A switch 18 shunts the filamentary resistance 13 producing dimming of the arc lamp when open and undimmed operation when closed. The diode 17, which is poled for easy current flow from the dc source of the arc lamp, has its anode coupled to one terminal of the resistance 13 and its cathode coupled to one terminal of the arc lamp 11. The arc lamp, which has a required polarization, has its anode coupled to the cathode of the diode 17 and its cathode coupled to one terminal of the current sensing resistance 33.

Continuing with a description of the operating network, a triggered monostable solid state switch is provided, constituted of a power transistor 19, a step-up transformer 20, and passive components 28, 29. The power transistor has base, emitter and collector electrodes. The step-up transformer 20 has a ferrite core for high frequency operation (>20 Khz), a main primary winding 21, a main second winding 22, a primary control winding 23 and a secondary control winding 24, all associated with the core. The control windings, as will be described, provide a transistor conduction control whose sense is responsive to the magnetic state of the ferrite core and produce monostable action, avoiding full core saturation. The main primary winding 21 has its undotted terminal coupled through the capacitor 25 to the positive source terminal and its dotted terminal connected to the interconnection terminal or node 26 between filamentary resistance 12 and 13. The main second winding of transformer 22 has its undotted terminal connected to the node 26 and its dotted terminal connected through the capacitor 27 to the anode of the arc lamp 11. The collector of the power transistor is connected to the node 26. The emitter of the power transistor 19 is coupled to the unmarked terminal of the primary control winding 23. The marked terminal of the primary control winding 23 is connected to the cathode of the arc lamp 11. The base of transistor 19 is coupled to the cathode of a clamping diode 28, whose anode is coupled through resistance 29 to the common dc terminal. The secondary control winding 24 has its unmarked terminal coupled to the base of transistor 19 and its marked terminal connected to the emitter. The base of transistor 19 is the point for application of a trigger pulse for initiating each conduction cycle.

The operating network is completed by the transistor 30 which, with its associated components, forms a triggering oscillator for recurrently turning on the solid state switching transistor 19. The trigger oscillator is turned on and off and also shifted in frequency in response to electrical conditions attributable to the electrical state of the arc lamp. The trigger oscillator is also responsive to the temperature of the switching transistor, thus preventing prolonged triggering in the event of arc lamp failure. The transistor 30 has its emitter coupled to the emitter of transistor 19, its base coupled through the capacitor 31 to the base of transistor 19, and its collector serially connected through the resistance 32 and positive temperature coefficient resistance 37 to the node 26. A voltage sensing voltage divider is provided consisting of resistance 34 connected between the anode of diode 17 and the base of transistor 30 and resistance 35 connected between the base of transistor 30 and the common source terminal. During warm-up and final run operation, both dc states of the lighting unit, the diode 17 is forward biased, and the divider output voltage, at the base of transistor 30, is a direct measure of the lamp voltage. During the high frequency states of the lighting unit, the diode 17 is reversely biased when power is delivered to the lamp, so that the voltage on the voltage divider reflects the loading effect of the arc lamp upon the transformer circuit and is an indirect measure of the lamp voltage. The connection of the emitter of transistor 30 to the non-referenced terminal of the resistor 33 in series with the arc lamp 11, makes the trigger oscillator responsive to lamp current in the form of the voltage proportional to the lamp current developed in resistance 33. The trigger oscillator is connected to respond in the manner noted above to the difference in sensed voltages.

In pre-ignition, ignition and glow to arc transition, the transformer 20, the transistor switch 19 and the trigger oscillator (30, etc.) of the operating network assume an active role in generating a high frequency output. The change in electrical output to dc occurring between the glow to arc transition and warmup is in response to conditions in the main lamp. More gradual changes in electrical output of the operating network occur between pre-ignition and ignition and between ignition and the glow to arc transition, and these changes are also in response to conditions in the main lamp.

In pre-ignition, ignition and the glow to arc transition, the operating network produces short duration, high voltage pulses for ignition of the arc lamp, the voltage falling to a lower value in response to lamp loading in the glow to arc transition. During pre-ignition, the unidirectional high voltage pulses have substantial ringing, and they occur at a rate of 50 KHz. In the glow to arc transition, the ringing is reduced and the frequency shifts to 35 KHz. The downward shift in frequency produces a shorter transistor conduction duty cycle, which increases the energy supplied to the lamp in the glow to arc transition. The operating network also supplies current to the filamentary resistance 12 in the form of a series of unidirectional pulses at the 50–35 KHz rate.

The operating network produces the high frequency electrical energization described above as a result of high frequency switching of the monostable transistor switch. Intermittent switching of the transistor switch produces an alternating component in the main primary winding 21 of the step-up transformer 20, a stepped up alternating component in the transformer output and a pulsating current in the filamentary resistance 12 which is primarily unidirectional.

Alternating current flow in the main primary winding takes place in the following manner. Assuming that the transistor 19 has been turned on by a suitable trigger signal coupled to its input junction, a displacement current path is completed between the positive and common terminals of the dc supply. That path comprises in order the capacitor 25, the main primary winding 21, the NPN switching transistor 19 (collector and emitter electrodes, respectively), the primary feedback winding 23 and the current sensing resistance 33. The switching transistor presents a low impedance when conducting, and the capacitor 25, the primary feedback winding 23 and the resistance 33 are also low impedances. As the current in the circuit increases, the primary feedback winding 23, which is inductively coupled to the secondary feedback winding 24, produces regenerative feedback in the input circuit of the transistor and turns it on more strongly. Accordingly, when the transistor conducts, the current rapidly builds up in the transformer primary winding, limited primarily by the primary inductance. The current build-up continues, however, until a prescribed flux level is reached in the core of the power transformer. At that point, the feedback is inverted to become degenerative, turning off the transistor 19 before full core saturation is reached. The The discontinuance of conduction through transistor 19 opens the prior path for current flow through the primary winding and allows a portion of the energy stored in the circuit to dissipate in the form of a reverse current through the filamentary resistance 12. Thus, the current flow, which was initially out of the dotted terminal of the primary winding when transistor 19 was conducting, reverses and the current now flows into the dotted terminal.

The transformed version of the high frequency alternating voltage appearing across the transformer primary winding during pre-ignition, ignition, and the glow to arc transition appears at the terminal of the winding 22 remote from winding 21. The output is coupled from the winding 22 by means of the capacitor 27 to the anode of the arc lamp 11. The output takes the form of unidirectional pulses by virtue of the presence of the diode 17 whose anode is coupled through filamentary resistance 13 (or the closed switch 18) to the undotted terminal of the secondary winding and whose cathode is coupled to the anode of the arc lamp. The diode 17 is poled to permit application of a stepped-up secondary voltage to the arc lamp developed during the reverse current flow in the transformer primary circuit and to suppress application of the secondary voltage developed during forward current flow when the switching transistor is conducting. With the indicated parameters, and assuming substantial ringing, the available pre-ignition potential is the 1600 volts peak to peak referred to earlier. Pre-ignition is nominally of zero duration when the lamp is cold and from 45 seconds to 4 minutes when the lamp is hot.

The transformer 20 is essentially an auto-transformer although in certain respects it may be regarded as a conventional transformer with separate primary and secondary windings. The windings 21 and 22 are serially connected, and wound in the same sense and the input is applied across the primary winding 21. When transistor 19 is conductive, the common terminal (node 26) between the primary and second windings is at reference potential and the voltage developed in the second winding reflects the primary to second turns ratio 500/140, with the diode 17 providing a short circuit and precluding the application of an output voltage to the main lamp. When the transistor 19 is nonconductive, stored energy developed across winding 21 and referenced through capacitor 25 to the B+ terminal of the power supply is released, and the device appears as an auto-transformer with the transformer ratio being 640/140. Thus, during the critical period when the transformer is delivering energy to the arc lamp, the transformer is in an auto-transformer configuration.

The current for standby illumination during pre-ignition, ignition, and the glow to arc transition is produced by high frequency switching of the transistor switch. At the instant that the transistor switch becomes conductive, a direct current path is completed between the positive and common terminals of the dc supply. The dc path includes the standby light producing filamentary resistance 12, the transistor 19 (collector and emitter electrodes, respectively), the primary feedback winding 23 and the current sensing resistance 33. The transistor 19 presents a low impedance, when conducting, and the primary feedback winding 23 and the resistance 33 are also low impedances. At the start of pre-ignition, the resistance of the filamentary resistance may also be low, and a large initial current ensues. Self-heating is rapid, and the resistance quickly reaches a relatively stable, larger value near 200 ohms, which persists throughout the balance of the starting procedure. The heat dissipation in the filamentary resistance during pre-ignition is set primarily by its own relatively large resistance, the duty cycle of the transistor switch and the dc voltage available from the dc power supply, and may be increased by adjustment of these parameters.

In addition to the intermittent current supplied to the filamentary resistance in the dc path just described, the return portion of the alternating current flowing in the primary winding 21 of the transformer also flows through the filamentary resistance as discussed earlier. During pre-ignition, with the secondary winding of the transformer 20 being substantially open-circuited, the heating effect of the reverse current in the primary circuit is negligible. During the glow to arc transition, when the lamp draws the more substantial energy, the alternating current adds significantly to the total dissipation in the filament, in which pulsating dc energization is reduced.

The operating network is responsive to the electrical state of the arc discharge lamp to produce the outputs previously characterized during pre-ignition, ignition and the GAT period. The means by which this responsiveness is accomplished includes the triggering oscillator (transistor 30, etc.) lamp current sensing resistor 33 and the voltage sensing resistors 34, 35.

The trigger oscillator causes active operation of the transistor switch 19 during pre-ignition, ignition and the GAT period and controls the transistor duty cycle to supply additional energy to the arc discharge lamp during the GAT period. Since the transistor switch is monostable, each trigger pulse supplied from the trigger oscillator initiates a conduction sequence.

In the event that the arc lamp does not "start" (i.e. reach warm-up) within a normal period and sensed conditions still dictate continuing high frequency operation, then after a prescribed additional period, the trigger oscillator will discontinue oscillations and the power supply will effectively turn itself off. Turn-off is achieved by a thermal latch, responsive to the temperature of the transistor switch 19. When thermally latched, the power supply can not be reactivated until it has been de-energized and allowed to cool. The operation of the thermal latch, which protects against a protracted starting sequence, will be taken up at the end of the discussion of the trigger oscillator.

The trigger oscillator is activated at the time the operating network is first energized, and remains energized through the pre-ignition, ignition and glow to arc transition. During pre-ignition, there is no lamp current, while during ignition and the glow to arc transition, the lamp current increases to one-fifth of an ampere peak in short pulses. The voltage developed in the transformer primary winding at node 26 is high (>300 V) during pre-ignition, falls appreciably under the loading affect of the lamp during ignition, and the glow to arc transition, and consists of a series of pulses initially with substantial ringing.

The foregoing current and voltage conditions reflecting the lamp condition during pre-ignition, ignition and glow to arc transition are sensed in the operating network and combined differentially at the input junction of the oscillator transistor, and used to activate the trigger oscillator. Any lamp current flowing in the lamp current sensing resistance, to which the emitter electrode of the junction transistor 30 is coupled via the low impedance feedback winding 23, produces a voltage in a sense tending to back-bias the input junction. (The lamp current is zero at the start and remains small during these lamp conditions.) The voltage at the node 26 is applied across the voltage divider 34, 35, the output tap of which is coupled to the base electrode of the transistor 30. The voltage appearing at the node 26 is positive and a fraction (1/181th) of that voltage is applied to the base electrode. Here, the voltage is in a sense tending to forward bias the input junction. During pre-ignition, the voltage at node 26 is a maximum and sufficient, assuming time has been allowed for the capacitor 31 to charge up, to forward bias the transistor 30 and initiate oscillation.

The trigger oscillator operates as a relaxation oscillator 31 being recurrently charged through the passive elements of the operating network and re-currently discharged by the transistors 19, 30. The charging period of capacitor 31 is determined primarily by the value of capacitor 31, the value of resistor 35 and, as will be shown, the differential voltage applied to charge the capacitor 31. The capacitor 31 has one terminal coupled to the base of the transistor 30, the output tap on the voltage divider 34, 35, and the other terminal coupled to the base of the switching transistor 19. The other capacitor terminal is led to ground through one path including the reversely poled diode 28 serially connected with resistance 29, and a second path including the serially connected, low resistance, feedback windings 24, 23 to the unreferenced terminal of the lamp current sensing resistance 33. The discharge of the capacitor 31 starts when transistor 30 begins to conduct, and is completed after the transistor switch 19 is turned on by transistor 30. With both transistors conducting, both terminals of capacitor 31 are coupled through a conducting junction to a common point, discharging the capacitor 31, and removing the forward bias on transistor 19, turning it off. The turn-off action of the transformer 20 leaves a residual inverse voltage on the capacitor at the end of switch conduction.

As an examination of the circuit will show, when sufficiently high potentials are present at the node 26 and assuming a low lamp current, the oscillator will start to conduct when the capacitor 31 reaches the value required to forward bias the input junction of the transistor 30 (+0.6 volts) as indicated above. The voltage on the capacitor is determined by the difference between the voltage at the voltage divider output and the voltage due to lamp current in resistor 33.

Once the transistor 30 conducts, current flows in the primary feedback winding 23 and the strongly regenerative feedback action involving secondary feedback winding 24 and capacitor 31 produces a short duration trigger pulse for turning on transistor switch 19.

The initial starting conditions and charging interval for each oscillation of the relaxation oscillator are established by the operating network. The capacitor 31 is fully discharged when both transistors 19 and 30 become conductive. The capacitor 31 assumes a reverse charge as a result of the feedback reversal in windings 23 and 24 attributable to maximum conduction by transistor switch 19. When conduction ends, a conduction inhibiting voltage of approximately 4 or 5 volts is produced on capacitor 31. The inverse voltage is limited by the serially connected diode 28 and resistor 29, and represents the starting point for each charging interval of the relaxation oscillator. While the transistor switch 19 is conducting, the virtual generators embodied by the voltage divider 34, 35 and the current sensing resistor 33 are inactive, precluding recharging of the capacitor 31, and precluding the starting of the next oscillation cycle.

Assuming that the arc lamp current has begun to flow and the voltage across the lamp has begun to increase, the differential voltage used to charge capacitor 31 falls on the average, increasing the period required to turn on the transistor 19 and initiate the next trigger pulse. This provides more time for the energy stored in the input circuit of the operating network to be released to the lamp. Earlier in the starting cycle, the lamp cathode current may be truncated by the next conduction interval, and less stored energy is delivered to the arc lamp. The circuit has been designed so that the nonconduction period is maximum when the lamp voltage is in the glow region (approximately 200–400 volts), to maximize the output power at about 9 watts for metal vapor lamps.

The charging time constant is about 5 microseconds and provides some smoothing within each pulse, reducing the noise sensitivity, but negligible pulse to pulse averaging. The principal function of the capacitor 31 is to serve as the integrating capacitor in the RC network used to time the off interval of the power transistor.

During pre-ignition, ignition and the glow to arc transition region, high frequency operation continues, with the trigger oscillator recurrently turning on the transistor switch 19 while the transistor switch turns itself off through feedback reversal in the transformer 20. The trigger oscillator transistor 30 is turned off shortly after conduction by transistor switch 19 removes the conduction favoring charge on capacitor 31. Transistor 30 remains quiescent through the balance of switch conduction. Turn-on of the transistor switch is achieved through the coupling of the base electrode of transistor 30 through the capacitor 31 to the base of transistor 19, the interconnection of the emitters of transistor 19 and 30 together, and the shared connection of the transistors 19 and 30 to the transformer feedback windings 23 and 24. When transistor 30 becomes forward biased, and starts to conduct, emitter current is developed in the primary feedback winding 23. This produces the regeneration needed to create a trigger pulse on the order of 1/10th ampere and having a submicrosecond duration at the secondary winding 24. The trigger current 23 flowing in the secondary winding 24 turns on the main switching transistor 19, initiating monostable switching action. Transistor 19 completes its conduction cycle, which is set by transformer design to be shorter than the interval between trigger pulses, and turns off in response to the reversal in feedback provided by the feedback windings 23, 24. High frequency operation of the switch continues so long as the trigger oscillator generates trigger pulses.

Once the arc lamp has reached thermionic operation corresponding to warm-up, the high frequency output produced by transistor switching is designed to stop and the dc state commences. The trigger oscillator 31, which triggers the monostable transistor switch 19 into active operation, remains reversely biased due to a new set of current and voltage conditions in the operating network and becomes inactive. The rectified high frequency voltage at node 26, previously applied across the voltage divider 34, 35 is replaced by a sustained dc voltage with some ripple, representing the lamp voltage. The dc voltage continues in a sense favoring conduction, but is lower by 1 or 2 orders of magnitude. The diode 17, now forward biased, connects the voltage divider across the lamp, and the voltage divider now senses 1/181th of the new lamp voltage, initially 15 volts. Simultaneously, a maximum initial lamp current of 6/10ths of an ampere occurs in resistor 33, developing a conduction inhibiting voltage of approximately 1.2 volts. The differential voltage produces a reverse bias on the input junction of the transistor switch 19.

As warm-up continues into final run condition, the lamp voltage rises and the lamp current falls. The lamp condition sensors are set to keep the trigger oscillator inactive through warm-up and final run. In final run, the lamp reaches a current of 0.3 amperes and a voltage of 87 volts. Should the lamp voltage rise 10 volts above the normal value (e.g., 97 volts) and the current fall to 0.050 ampere, then the trigger oscillator will be reactivated as a safeguard against transistor dropout.

If the arc lamp does not reach thermionic operation during a predetermined period, the operating network is designed to turn itself off and to so remain until it is de-energized and allowed to cool. The turn-off mechanism is automatically responsive to the temperature rise of the power transistor 19. It relies on the circumstance that higher temperatures occur in the power transistor—which operates only during starting or restarting—when the arc lamp is either not starting at all or starting very slowly. Normal starts or restarts are of shorter duration and because the periods involved are shorter than the times required for the devices to reach thermal equilibrium, lower temperatures are attained. In short, the temperature rise of the switching transistor may be regarded as a reliable symptom of arc lamp or circuit malfunction. In accordance with this principle, the system is designed to shut down when pre-assigned temperatures are exceeded in the switching transistor. Without such a provision an unattended lighting unit would continue to operate in the starting mode for an appreciable period—normally measured in days. The technique herein described avoids the generation of prolonged electromagnetic interference and wasted power.

Figure 4:
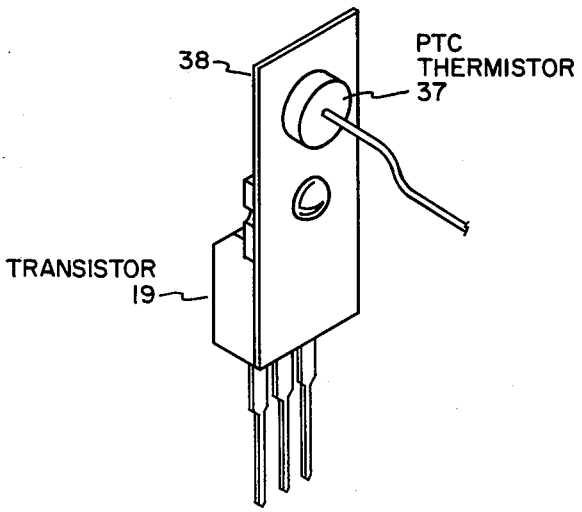
FIG. 4 is an illustration of the switching power transistor which forms a portion of the power supply unit with an attached positive temperature coefficient thermistor designed to prevent prolonged application of starting potentials after arc lamp failure.

The positive temperature coefficient resistor or thermistor 37 is the sensor for the automatic turn off mechanism just described. As shown in FIG. 2, the positive temperature coefficient resistor 37 is electrically connected in the collector current path of the trigger transistor 30, being connected between the one kilohm resistance 32 and the node 26. As shown in FIG. 4, the PTC resistor 37 is attached through an optional intermediate metallic member 39 to the heat conducting collector tab of the power transistor 19, the attachment providing both mechanical support to the PTC resistor and good thermal contact between it and the power transistor. The electrical connection of one thermistor terminal to the collector electrode of the power transistor is permitted since both are connected to the node 26.

The positive temperature coefficient resistor or thermistor may be of a conventional type. When exposed to a heat source, causing the device to exceed a threshold temperature, the device exhibits a very strong increase in resistance with temperature. The rate of resistance increase may be by a factor of 10 for each 10° C. increase in temperature. The conventional thermistor consists of a suitably electroded semiconductor ceramic. The ceramic is manufactured by sintering a material whose principal ingredient is barium titanate and whose exact composition is adjusted by non-stoichiometric combination and/or the addition of small quantities of other materials for optimization of its semi-conducting properties. The thermistor frequently takes the form of a shall cylindrical member with electrodes on the ends. A suitable thermistor for use in the present application has a value of less than 20 ohms when below the knee of the resistance/temperature curve which occurs at 70°. Values in excess of 10,000 ohms may be reached when the thermistor is exposed to temperatures in excess of 110° C.

In the practical circuit illustrated in FIG. 2, there is a "window" between the transistor temperatures accompanying a normal start or restart and those implying lamp circuit abnormality. At normal temperatures, the thermistor has a value sufficiently low that its influence on the circuit is negligible. On the other hand, at elevated temperatures, the resistance value becomes sufficiently high to preclude normal operation of the trigger oscillator.

The operation of the thermal latch will now be explained. During a normal start, the transistor switch 19 may operate for a few seconds before the arc lamp "starts", i.e., begins thermionic emission, after which the power transistor is turned off. For a start at room temperature, the case of the lighting unit is typically 28° C. During the starting process, the temperature of the power transistor may increase slightly but it will remain well under the knee of the thermistor resistance characteristic. As normal operation of the arc lamp continues, the trigger oscillator and the switching transistor remain quiescent, but the temperature in the case housing the thermistor and power supply unit will increase from room temperature to an equilibrium temperature of 70° C. At this point, the thermistor is still below the knee of its temperature characteristic and has a value of less than 30 ohms.

A "hot restart" provides a set of higher temperature conditions still indicative of circuit normalcy. In a hot restart, the user has turned off the lighting unit, but without allowing it to cool has turned it back on again. Under these conditions, the arc lamp is at maximum temperature (much higher than the room temperature) and pressure and will not respond to the available ignition potentials until it has been allowed to cool. The cooling of the arc lamp to the point where it will ignite, normally takes from 45 seconds to several minutes. During this period, the trigger oscillator and the switching transistor continue to operate, producing normal ignition potentials until the arc lamp has started (entered warm-up). At the beginning of the hot restart, the thermistor is at the case temperature of approximately 70° C. Assuming that a single hot restart may require two minutes of operation, the temperature at the tab of the switching transistor will elevate as a result of self-heating from 5 to 10 degrees above the case temperature. In the event that a second hot restart is attempted, and assuming that no additional time is allowed for cooling, the tab temperature will increment an additional 5 to 10 degrees. This final temperature, assuming a second voluntary hot restart and normally lying between 85° and 100°, corresponds to the highest temperature that one may expect assuming normal operation. This temperature sets the lower boundary to the thermal "window".

The upper limit to the thermal window is the temperature that one would expect from a failed lamp. In the event of a failed lamp, the tab temperature will normally continue to elevate until thermal equilibrium is reached in the vicinity of 125° C.

Under the indicated circumstances, the positive temperature coefficient resistor should be selected to cause a circuit response at tab temperatures between 90° C. and 125° C., or typically 100° C. A satisfactory positive temperature coefficient resistor exhibits a knee in its characteristic of 70° C., a cool resistance of approximately 10 ohms at 28° C. and 10,000 ohms in the vicinity of 105° C.

The circuit is designed to respond to the resistance change of the thermistor, when it reaches approximately 3000 ohms, corresponding to a temperature near 100° C. When this resistance is reached, the current pulse from the trigger transistor is reduced from its maximum value to a value no longer capable of turning on the power transistor. Since the power transistor cannot come on to discharge the capacitor 31, relaxation oscillations cease. Without the drain produced by the switching transistor 19, the voltage on the electrolytic capacitor 16 rises to about 170 volts. The dc circuit conditions force the trigger transistor 30 into medium current (10 ma) saturation. Base current is supplied by the 180 K resistor 34 to forward bias the input junction. The output junction loses in reverse bias, with a major portion of the B+ voltage in the collector circuit being developed across the positive temperature coefficient resistor 37, which now has a large value. Under the indicated conditions, collector current flowing through the thermistor will be about 10 milliamperes, producing a dissipation of about a watt in the thermistor. This dissipation is set to maintain the thermistor in a high resistance state (greater than 3000 ohms) from self-heating. The power unit will remain latched in a low current latched condition so long as the power remains on. Should the power be removed long enough for the thermistor to cool down below the transition temperature (a period of above 5 seconds) the circuit will again revert to a hot restart condition. The present circuit reaches the latching state after about 10 minutes of hot restart operation, and unlimited starting is precluded.

The thermistor must meet several requirements. The thermistor must reach a sufficiently high resistance state in response to an abnormal temperature rise in the switching transistor (19) to halt oscillations by the trigger oscillator, this result being accomplished by forcing the oscillator transistor 30 into medium direct current saturation, pre-cluding significant current gain. The path for direct heat transfer from the switching transistor to the thermistor is of high thermal conductance, being designed to conduct sufficient heat to the thermistor in the context of other cooling effects to bring the thermistor to the necessary high value within the desired latch-out period.

Once at the elevated temperatures required to stop oscillations, the high resistance value and the saturation current level in the transistor 30 must provide sufficient "self" dissipation in the thermistor to sustain the thermistor temperature at a value required to prevent further oscillation, i.e., provide a thermal latch. The saturation current is adjusted in part by the resistance values in the voltage divider network (34, 35) and the collector load resistances including the thermistor. As stated earlier, a current of ten milliamperes is a practical value.

Thirdly, the thermistor is selected to be non-responsive to self-heating at the current levels corresponding to normal oscillations at maximum normal temperatures. The trigger oscillator is a relaxation oscillator, which permits the periods of conduction and non-conduction to be unequal. In the interests of energy conservation, the trigger oscillator should dissipate a relatively small amount of energy in relation to that dissipated in the switching transistor which it controls. For this reason, it is desirable that the conduction periods be very short and the duty cycle low. The conduction need only persist for a few hundred nanoseconds with current peaks of 100 milliamperes at a duty cycle of one-fiftieth for effective triggering. Under these conditions, the average current is 2 milliamperes. Assuming that the thermistor is at the maximum design resistance, e.g. 10 K, the self-heating effect of the thermistor is 0.040 watts and insufficient for self-latching, assuming typical cooling within the case 10. On the other hand, assuming 10 milliamperes current during saturation of the transistor 30 and 10 K thermistor resistance, the self-heating effect is approximately 1 watt and sufficient for thermal latching.

The time constant for activation of the thermal latch may be controlled by adding thermal insulation or ventilating the thermistor; by choice of a larger or smaller total thermal mass, including that of the thermistor, the transistor and the mechanical support; and by increasing or decreasing the thermal conductivity between the power transistor and thermistor. The primary heat source or thermal generator is the power transistor 27. (A second potential heat source, not exploited in the present embodiment is the current sensing resistor 33.) The power transistor normally is on less than a minute, which is an insufficient time for the transistor or the attached thermistor to reach terminal temperatures. By adding to the associated thermal masses it is possible to delay the sensed temperature rise by one or more minutes. In addition, the terminal temperatures reached by the power transistor and attached thermistor can be made usefully high and well above normal operating temperatures by controlling the surface design and radiating area to reduce convection, conduction, and radiation heat loss. In short, it is practical to set a threshold. Operation below this threshold may be characterized as normal and allowed to continue and operation above this threshold may be characterized as abnormal and further operation prevented.

Returning to the practicalities of thermal design; several methods for mounting the thermistor to the transistor to establish practical electrical and thermal contact may be employed. One method applicable to the disc-shaped thermistor employs conductive epoxy between the thermistor electrode and the power transistor tab or between these elements and a third conductor (e.g., 38). This provides both electrical connection between one side of the thermistor and the power transistor collector and a desirable good thermal path between them. The flying lead of the thermistor is attached to the other electrode for connection to the 1 kilohm resistor in the collector circuit of the trigger oscillator. Insulation may be used around the combination to speed up the latch-up process but is normally not required. More heat sinking may be used to slow the latch-up down. In a practical embodiment, the metal conductor 38 is used, which also adds to the thermal mass. It is a generally flat sheet of copper whose dimensions are $0.375'' \times 1.00'' \times 0.010''$.

The thermistor employed should have a voltage rating suitable for the intended use and be of sufficiently low electrical capacitance as not to interfere with the shutoff process. Typical manufacturers' voltage ratings lie between 120 and 170 volts. The capacitive reactance between the thermistor electrodes at the triggering frequency should be small in relation to the latching resistance of the thermistor. Preferably, the capacitance should be no more than 500 picofarads. The proper capacitance value may be achieved by selecting a thermistor with reduced cross-sectional area and increased electrode spacing consistent with maintaining adequate electrical power dissipation to maintain the thermistor in a latched-up condition. In a practical embodiment, the thermistor has a diameter of approximately $\frac{1}{4}''$ and a thickness of 0.105".

The thermistor 37, as described, is both electrically and thermally connected to the power transistor 19. The thermal interconnection is desirable since it places the thermistor in thermal contact with the circuit element whose temperature experiences the greatest change in temperature between normal and abnormal operation as defined above.

The thermal contact of the thermistor to the collector of the switching transistor is preferable to any other circuit points because the temperature change there is greatest between normal and prolonged starting conditions, and direct electrical connection may also be made. A second choice is to the 2 ohm resistor 33, which also becomes substantially hotter during prolonged starting than during normal operation, but which has a substantially narrower thermal window than the transistor collector tab.

While thermal contact between the thermistor and the power transistor is essential, electrical contact is not. Thus, the thermistor 37 could be interchanged in the circuit with the load resistance 32 of the trigger oscillator. The disadvantage of this interchange is that the thermal contact between the thermistor and power transistor must now be electrically isolated, as by the interposition of a thin insulative barrier which would involve additional expense. In practice, it is preferable to use the illustrated simpler combined thermal and electrical contact. The illustrated electrical contact is made at the node 26 where it has no electrically adverse affect upon the operation of the switching transistor 19. The position of the thermistor 37 in the collector circuit of the trigger oscillator transistor 30 is also advantageous in that in effecting saturation it produces no impairment in the oscillator output function except as it is desired, and no impairment of the input response of the trigger oscillator to arc lamp voltage and current which involve the base and emitter electrodes of the transistor 30.

What is claimed is:

1. A lighting unit comprising:

A. a dc power supply having a first and a second output terminal,

B. a main arc lamp requiring energization dependent on its electrical state connected in a series path between a node and said second supply output terminal, C. a filamentary resistance for providing standby illumination, said filamentary resistance being connected in a series path between said first supply output terminal and said node for normal energization and resistive ballasting of said main lamp, D. an electrical transformer having a primary winding connected in a series path between said first supply output terminal and said node and a second winding connected in a series path between said node and one terminal of said main lamp for applying lamp starting potentials when an alternating potential is applied to the primary thereof, E. a monostable, normally non-conductive, solid state switch comprising a first transistor connected in a series path between said node and said second supply output terminal, intermittent operation thereof developing (1) an alternating potential in said primary winding and a transformed alternating potential in said second winding for starting or restarting said main lamp, and (2) a pulsating current in said filamentary resistance, F. a trigger oscillator responsive to the electrical state of said main lamp for causing intermittent switch conduction for starting or restarting said main lamp, comprising a second transistor having base, emitter and collector electrodes, connected in an oscillatory configuration, and G. means for latching said trigger oscillator in a non-oscillatory condition when said intermittent operation is excessively long, said latching means comprising a positive temperature coefficient resistor thermally coupled to a member experiencing a greater temperature rise during starting or restarting than during normal energization, and electrically connected in the current path to the collector of said second transistor, said resistor, when at a low temperature corresponding to normal operation permitting oscillation and when at an elevated temperature corresponding to abnormal operation, stopping oscillation at a current level providing sufficient self-heating in said resistor to prevent further oscillation until said lighting unit is de-energized and said resistor is allowed to cool.

2. The arrangement set forth in claim 1 wherein said member is said first transistor.

3. The arrangement set forth in claim 2 wherein

A. said positive temperature coefficient resistor is connected in the series path between the collector of said second transistor and said node, and B. said positive temperature coefficient resistor prevents oscillation by biasing said second transistor into saturation at a current level sufficient for the self-heating of said resistance to maintain saturation, the average oscillator current during oscillation being significantly less than during saturation.

4. The arrangement set forth in claim 3 wherein

A. said trigger oscillator is a relaxation oscillator comprising a resistive voltage divider serially connected between said node and said second output terminal, and a capacitor which is recurrently charged and discharged;

B. the base of said second transistor is connected to one capacitor terminal and to a tap on said voltage divider for sensing the voltage across the arc lamp, the emitter of said second transistor is connected to an impedance connected between one arc lamp terminal and said second supply output terminal for sensing the current in said arc lamp; and C. said positive temperature coefficient resistor has one terminal electrically connected to said node.

5. The arrangement set forth in claim 4 wherein

A. said first transistor has a metal tab electrically and thermally connected to the collector thereof, and B. said positive temperature coefficient resistor is electrically and thermally coupled to said metal tab for response to the self-heating of said first transistor.

* * * * *